US005791424A

United States Patent [19]

Moser et al.

[11] Patent Number: 5,791,424

[45] Date of Patent: Aug. 11, 1998

[54] DRILL BIT FOR THE ROTARY-PERCUSSIVE DRILLING OF PREFERABLY ROCK, CONCRETE OR THE LIKE

[75] Inventors: Bernhard Moser, Altshausen; Hans Peter Meyen, Wolpertswende, both of Germany

[73] Assignee: Hawera Probst GmbH, Ravensburg, Germany

[21] Appl. No.: 610,404

[22] Filed: Mar. 4, 1996

[30] Foreign Application Priority Data

Mar. 3, 1995 [DE] Germany ..... 195 07 487.4

[51] Int. Cl.[6] ..... E21B 10/04; E21B 10/44

[52] U.S. Cl. ..... 175/394; 175/404; 175/405; 175/415

[58] Field of Search ..... 175/403, 404, 175/405, 405.1, 402, 415, 394; 408/204, 205

[56] References Cited

U.S. PATENT DOCUMENTS

| | | | |
|---|---|---|---|
| 1,559,680 | 11/1925 | Denne | 408/204 |
| 1,572,386 | 2/1926 | Gates | 175/404 |
| 3,055,443 | 9/1962 | Edwards | 175/404 |
| 3,127,944 | 4/1964 | Davis | 175/405.1 |
| 3,845,830 | 11/1974 | Fowler et al. | 175/404 |
| 5,015,128 | 5/1991 | Ross, Jr. et al. | 175/405.1 X |
| 5,213,456 | 5/1993 | Lee | 408/204 |

FOREIGN PATENT DOCUMENTS

| | | | |
|---|---|---|---|
| 0 126 409 B2 | 8/1993 | European Pat. Off. . | |
| 841892 | 4/1952 | Germany | 175/404 |
| 27 25 368 | 2/1979 | Germany . | |
| 3705717 | 8/1988 | Germany | 175/385 |
| 30 49 135 | 9/1991 | Germany . | |
| 1653910 | 6/1991 | U.S.S.R. | 408/204 |

*Primary Examiner*—Hoang C. Dang
*Attorney, Agent, or Firm*—Spencer & Frank

[57] ABSTRACT

A drill bit is proposed, in particular for the rotary-percussive drilling of preferably rock, concrete or the like, which includes a thin-walled cylindrical drilling body (106) open to the drilling side and a drill-bit base (20) extending essentially radially and having an axially arranged drill-bit shank (101) for fastening the drill bit. The drill-bit base (20) has an outer contour in the radial direction, which outer contour follows a curve shape which has at least one inflection point. Furthermore, a drill bit is proposed whose drill-bit base (20) has an outer contour which passes through a minimum in the radial direction, the drill-bit base being connected in the rising radially outer curve section of its outer contour to the cylindrical drilling body. Further independent features of the drill bit according to the invention are at least one prominence (19) on the inside of the drill-bit base for crushing the material to be drilled, which prominence (19) projects from the contour of the inside, or a cuttings-discharge flute (109) having a variable helix angle on the outer contour of the drilling body (106).

30 Claims, 4 Drawing Sheets

| Dm. | 80 | 90 | 100 |
|---|---|---|---|
| b2= | 0.6 | 0.6 | 0.6 |
| b3= | 0.4 | 0.4 | 0.4 |
| c3= | 1 | 0.9 | 0.8 |

DRILL BIT FOR THE ROTARY-PERCUSSIVE DRILLING OF PREFERABLY ROCK, CONCRETE OR THE LIKE

BACKGROUND OF THE INVENTION

The invention relates to a drill bit for the rotary-percussive drilling of preferably rock, concrete or the like.

Drill bits of the type described above have already been disclosed, in which the drill-bit base extends essentially radially outward in a straight line perpendicularly to the axis of rotation or also inclined slightly to the drilling side. In these embodiments, the outer contour of the drill-bit base generally follows the contour of the inside of the drill-bit base in significant sections.

In operation, a percussive motion induced by a drilling mechanism should be transmitted during rotary percussive drilling in the best possible manner via the drill-bit shank and the drill-bit base to the open front-end drilling side of the cylindrical drilling body. In the known embodiments mentioned above, however, there are large vibration losses during the transfer of the percussive motion which considerably reduce the drilling capacity.

In addition, a further disadvantage generally occurs in the embodiments described during the rotary-percussive penetration of the thin-walled cylindrical drilling body into the material to be drilled. Just before reaching a drilling depth which as a rule is determined by the length of the cylindrical drilling body, drilled material already released, such as rock fragments for example, may jam between the largely flat drill-bit base and the still firm material to be drilled and may prevent further penetration of the drilling body to its full length.

Accordingly, the problem of the present invention is to optimize a drill bit in particular for rotary-percussive drilling. In this case, as already mentioned, the percussive energy applied to the insertion shank is to be converted with as high an efficiency as possible, i.e. with low losses, for crushing the rock. The problem of converting the percussive energy is discussed, for example, in German Patent Specification DE 30 49 135 C2. The general trend in the development of drill bits is for the inert mass to be reduced overall in order to convert the percussive energy into drilling work with a minimum of losses. Therefore the drill-bit base, the insertion shank and also in particular the wall sections of the bit part are always designed to be of lower mass, i.e. thinner, in order to produce low interia counterforces. However, thinner wall sections, in particular in the drill-bit base, may also result in vibrations, which, however, should not have an adverse effect on the drilling capacity. In particular, no vibrations should occur which lead to stationary waves inside the drilling tool and thus consume energy through corresponding sound radiation or heating. A drill bit which is thin-walled overall must therefore likewise be optimized in terms of vibration, provided it is subjected to high percussive loads.

Normal or conventional thin-walled drill bits generally have no delivery helix on the outer contour of the bit part. In particular in thin-walled drill bits having a wall thickness of the bit part in the order of magnitude of about 5 mm, no normal cuttings flutes can be made, since this would lead to considerable weakening of the wall thickness. In German Offenlegungsschrift 27 35 368, a rock drill bit having an outer delivery helix in the area of the bit part is shown, which delivery helix serves to remove the cuttings. It is also apparent from this prior art that the cuttings flute in drill bits can only be made to a small depth in order not to cause any excessively pronounced weakening of the wall thickness. The subject matter of this publication also deals with the question of the longitudinal vibrations of the drilling tool occurring during the drilling process, which vibrations are to be kept as small as possible. In this way, the sound emission is also to be kept down.

Small delivery-helix flutes, i.e. delivery-helix flutes only made to a small depth, have the disadvantage that only a small amount of cuttings transport is possible. Therefore the present invention provides for a further development of the delivery-helix arrangement on a drill bit to the effect that both the vibration behavior and thus an optimum power transmission as well as the cuttings transport and the enhanced node of action brought about by this, in particular in drill bits of thin-walled design, are improved.

SUMMARY OF THE INVENTION

The object of the invention is to remove the disadvantages of known drill bits and to improve in particular the efficiency or the drilling properties of a drill bit from the aspect of vibration control.

The essence of the invention is that a drill bit, which is used in particular for the rotary-percussive drilling of preferably rock, concrete or the like and essentially comprises a thin-walled cylindrical drilling body open to the drilling side and a drill-bit base extending essentially radially and having an axially arranged drill-bit shank for fastening the drill bit, is provided with a drill-bit base which has an outer contour in the radial direction, which outer contour follows a curve shape which has at least one inflection point. Due to such a shape of the drill-bit base, a percussive motion induced by the drilling mechanism is transmitted with especially low losses to the cylindrical drilling body. Regarded physically, the drill-bit base according to the invention has less damping than a drill-bit base of conventional type of construction. On the one hand, this can be attributed to the predominantly elastic vibration properties of the drill-bit base according to the invention. On the other hand, in the drill bit according to the invention, there is a more balanced mass distribution in the axial direction compared with conventional embodiments. This applies in particular to designs in which a predominantly horizontally running drill-bit base follows the drill-bit shank. Consequently, there is a jump in cross-section, for example by the factor 10, at the interface of drill-bit shank and drill-bit base and, when considering small disk elements lying perpendicularly to the axis of rotation, there is therefore also a corresponding jump in mass. As a result, in conventional designs an oncoming percussive impulse is partly reflected or partly damped at this point, so that a considerable transmission loss of the percussive motion occurs up to the drilling body. In an embodiment of the drill-bit base according to the invention, such a jump in cross-section with the associated jump in mass is not present at the transition from drill-bit shank to drill-bit base. Due to the more uniform mass distribution in the transition area between shank and cylindrical drilling body of the drill bit according to the invention and due to the possibility of the drill-bit shank being able to perform vibratory motions relative to the drilling body on account of the drill-bit base according to the invention, an improvement in the drilling capacity of up to 50% compared with the previously known designs is obtained.

It is especially advantageous if the curve shape which determines the outer contour of the drill-bit base is a continuously differentiable function. By the avoidance of steps and edges, the service life of the drill bit can be prolonged and in addition a uniform, continuously differentiable curve shape can easily be produced with a CNC lathe.

It is especially preferable if the curve shape which determines the outer contour of the drill-bit base is a vibration dying out in a damped manner to the outside over the radius of the drill-bit shank. In this way, an especially uniform mass distribution from drill-bit shank via drill-bit base to the drilling body is achieved, in which case especially low damping losses occur during the transmission of percussive impulses by a drilling mechanism.

Furthermore it is very favorable if the contour of the inside of the drill-bit base follows a curve shape which has at least one inflection point. A curve shape similar to that on the outside of the drill-bit base is thus obtained, it being advantageous if the contour of the inside follows the outer contour in significant radial sections. In this way, manufacturing material can be saved.

In addition, it is advantageous if the wall thickness of the drill-bit base, at least in the radially outer section, lies within the range of the wall thickness of the cylindrical drilling body. By the drill-bit base being made to the wall thickness of the cylindrical drilling body, up to 30% material can be saved and in addition an especially uniform mass distribution in the drill bit can be achieved, which results in a correspondingly good drilling capacity.

It can likewise be of advantage if the curve shape which determines the outer contour and/or inner contour of the drill-bit base is realized in each case by linear sections.

To achieve the object, it is especially advantageous as a further essential idea if the drill-bit base has an outer contour which passes through a minimum in the radial direction, the drill-bit base being connected in the rising radially outer curve section of its contour to the cylindrical drilling body. This is especially advantageous when drill bits of relatively small diameter are produced. For this case, the outer contour of the drill-bit base cannot construct a complete curve shape, wherein the drill-bit base has an outer contour in the radial direction that follows a curve shape having at least one inflection point, but merges into the cylindrical drilling body before reaching the inflection point. A clear improvement in the drilling capacity is also obtained for this curve shape of the contour of the drill-bit base for the same reasons mentioned above.

Likewise, to achieve the object, it is especially advantageous as a main feature if at least one prominence projecting from the contour of the inside is provided on the inside of the drill-bit base it crushing the material to be drilled. When the drilling body penetrates into the material to be drilled, rock fragments can be crushed just before reaching the maximum drilling depth by at least one projecting prominence on the inside of the drill-bit base so that the further drilling operation is not jammed and the drill bit reaches its maximum drilling depth.

Furthermore, it is advantageous if the prominence projecting from the contour of the inside of the drill-bit base is an annular bead. This annular bead may be obtained in a simple manner, in particular when the contour of the inside of the drill-bit base follows the outer contour in significant radial sections. Likewise, an annular bead or oval bead or repeatedly interrupted bead may of course be additionally made on the inside of the drill-bit base.

It is especially preferred if the contour of the inside of the drill-bit base runs up at an angle in the direction of the drill-bit shank in the radially inner area to form a conical hollow space up to the locating point, for example, of a center drill. Cuttings which arise during the precrushing of smaller rock fragments just before reaching the greatest drilling depth by at least one prominence projecting from the contour of the inside of the drill-bit base can escape into the conical hollow space. Thus not only can the drill bit penetrate to the full drilling depth but blockage of cuttings at a greater drilling depth is also prevented.

Furthermore, the design according to the invention of delivery-helix arrangement according to further development of the invention has the advantage that the efficiency of such a drill bit can be further improved. In this case, the central idea of this further development according to the invention is that the delivery-helix arrangement is improved in terms of vibrations and with regard to the volumetric delivery of the cuttings per unit of time.

The earlier Patent EP 0 126 409 has certainly disclosed the basic problem of jumps in cross-section in delivery helices and the vibrations associated therewith in the case of a normal rock-drilling tool. In the case of such a drilling tool, it was proposed in particular to vary the flute helix angle over the delivery-helix length in order to avoid equidistant jumps in cross-section between the flute root and the webs of the delivery helix. However, this is a drill geometry and in particular a delivery-helix geometry which differs fundamentally from that of the flat-helix-shaped drill bits.

According to the present invention, a delivery-helix design is now to be realized in a drill bit, in which delivery-helix design the outer delivery helix has a cuttings-discharge flute which on the one hand has a helix angle increasing toward the shank end. This is intended to give rise to a constant increase in the width of the cuttings flute starting from the front end of the drilling tool. On the other hand, the crest width of the delivery-helix webs is to be as small or as narrow as possible, and as far as possible constant.

On account of the only small or variable depth of the cuttings flutes in the drill bit according to the invention in the order of magnitude of, for example, 1 to 1.5 mm, the flute width is accordingly widened continuously or discontinuously on account of an increasing helix angle, the volume of the cuttings flute also increasing. At the same time, however, the crest width of the webs of the delivery helix of the drill bit, which webs are relatively wide compared with a normal drilling tool, is to remain approximately constant over a wide range.

Equidistant jumps in cross-section of the delivery helix are avoided by these measures so that, inter alia, small stationary waves with corresponding energy absorption also do not form. This also enables the sound emission to be reduced. Furthermore, rapid removal of the cuttings is effected on account of the constantly, in particular continuously, increasing helix angle of the cuttings flute and the constantly increasing cuttings-flute volume. Optimization of the vibration properties by these measures makes it possible to select relatively small wall thicknesses in both the bit base and the lateral wall area, which leads overall to low masses. The optimization of the vibration properties permits such an overall reduction in the mass of the drill bit, with improved transport properties of the cuttings. A variation in the flute depth with a larger flute depth at the tool head in the cutting area and a flute depth which may decrease continuously if need be in the direction of the clamping shank likewise results in an increase in the flute volume within the range of a small flute helix angle and in strengthening of the drill bit in the area toward the shank end through increasing wall thickness.

BRIEF DESCRIPTION OF THE DRAWINGS

Several exemplary embodiments of the invention and a mathematical function for better understanding of the invention are shown in the drawings and are described in more detail below while specifying further advantages and details. In the drawings.

DESCRIPTION OF THE PREFERRED EMBODIMENTS

Figure 1:
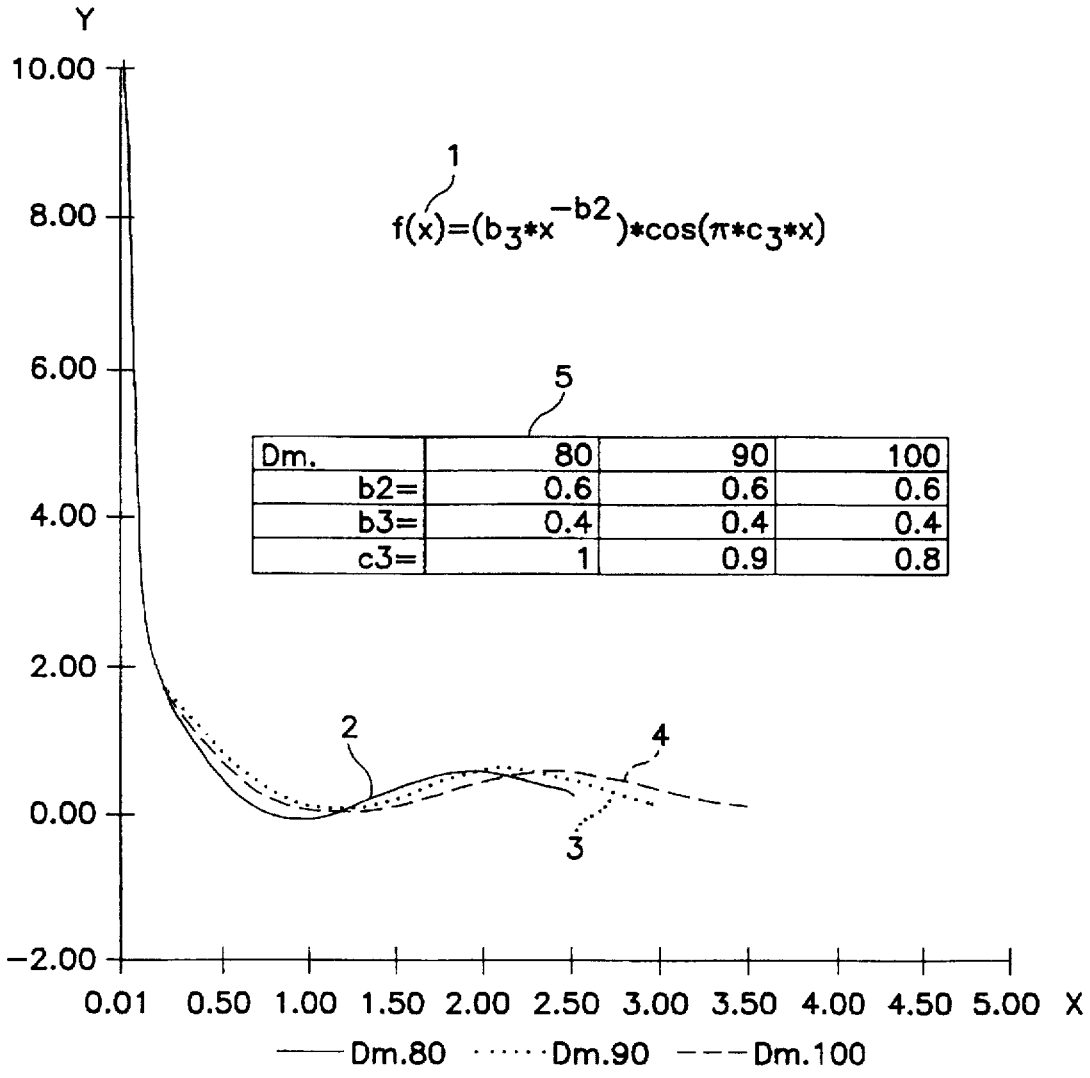
FIG. 1 shows a diagram having a plurality of curve shapes according to which the drill-bit base of a drill bit may be designed.

FIG. 1 shows a diagram having three different undulating curve shapes which determine, for example, the outer contour of a drill-bit base for three different diameters. In the diagram, the horizontal x-axis describes the radial curve shape and the vertical y-axis describes the axial curve shape. The curve shapes can be analytically represented by the mathematical function 1. For example, the curve shape 2 may be used for the radial course of the outer contour of a drill-bit base of a drill bit having a diameter of 80 mm, the curve shape 3 may be used for a drill bit having a diameter of 90 mm, and the curve shape 4 may be used for a drill bit having a diameter of 100 mm. In the table likewise included in the diagram, the associated parameters b2, b3 and c3 of the function 1 are specified in order to obtain the respective curve shape. The three curve shapes concern a vibration dying out in a damped manner (that is, they have sinusoidal shapes with amplitudes that decrease radially outwardly). Here, the curve shape 2 has one inflection point and the curve shapes 3 and 4 have two inflection points on account of the adaptation to a greater drill-bit diameter.

Figure 2:
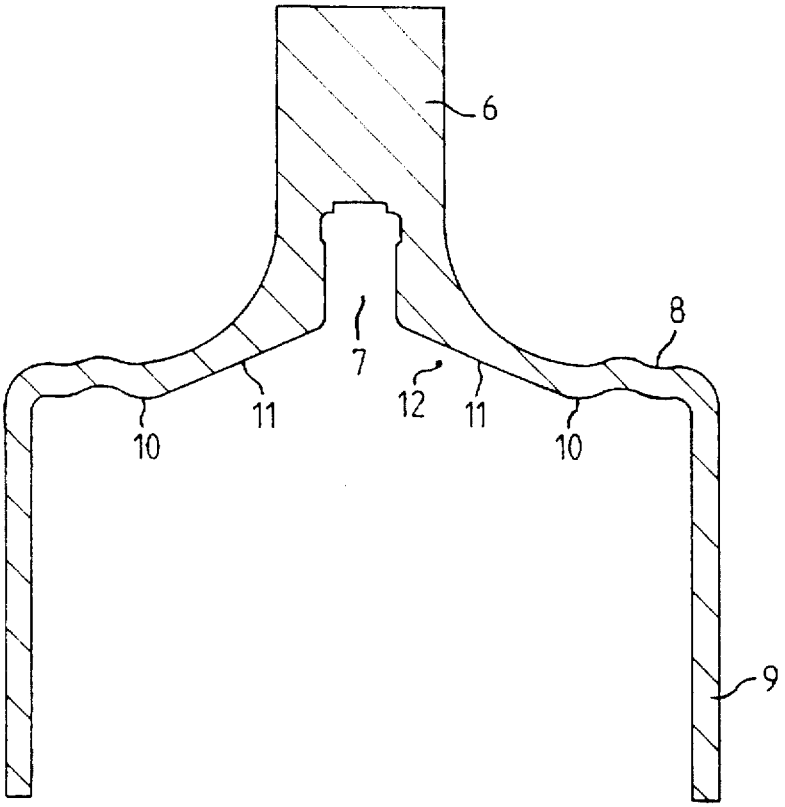
FIG. 2 shows an axial cross-section of a drill bit according to the invention, the curve shape of the drill-bit base having two inflection points in the radial direction.

In FIG. 2, a first exemplary embodiment of a drill bit according to the invention is shown in cross-section through the axis of rotation. The drill bit consists of a drill-bit shank 6, a bore 7 for accommodating a center drill, a drill-bit base 8, the outer and inner contour of which has a curve shape corresponding to a vibration dying out in a damped manner, and the cylindrical, thin-walled drilling body 9 open to the drilling side. In this arrangement, the wall thickness of the drill-bit base 8 lies within the range of the wall thickness of the drilling body 9 in significant radial sections. The drill bit is made in one piece, but in other embodiments may also be multi-piece.

The inner contour of the drill-bit base 8 has an annular bead 10, projecting from the contour of the inside, for crushing the material to be drilled just before reaching the maximum drilling depth. The annular bead is substantially determined by the curve shape of the inner or outer contour of the drill-bit base. To receive cuttings, the contour of the inside of the drill-bit base 8 runs up at an angle in the radially inner area 11 to form a conical hollow space 12 up to the locating point of the center drill 7.

Figure 3:
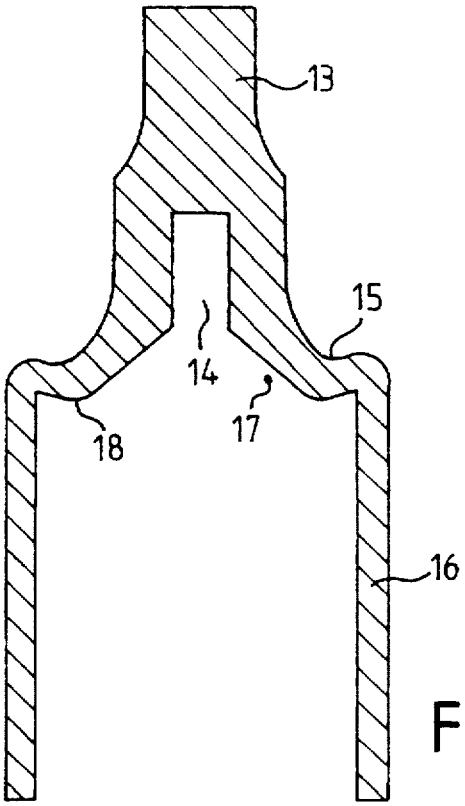
FIG. 3 shows an axial cross-section of a drill bit according to the invention, the drill-bit base of which passes through a minimum in the radial direction.

FIG. 3 shows a second exemplary embodiment according to the invention in the form of a drill bit for small diameters. The exemplary embodiment likewise has a drill-bit shank 13, a bore 14 for accommodating a center drill 14, and a drill-bit base 15, which unlike the first exemplary embodiment, however, has an outer contour which consists of a truncated vibration dying out in a damped manner and consequently has no inflection point but passes through a relative extremum (a minimum) in the radial direction, the drill-bit base being connected in the rising curve section of its outer contour to the cylindrical drilling body 16. The second exemplary embodiment likewise has a conical hollow space 17 and an annular bead 18.

Figure 6:
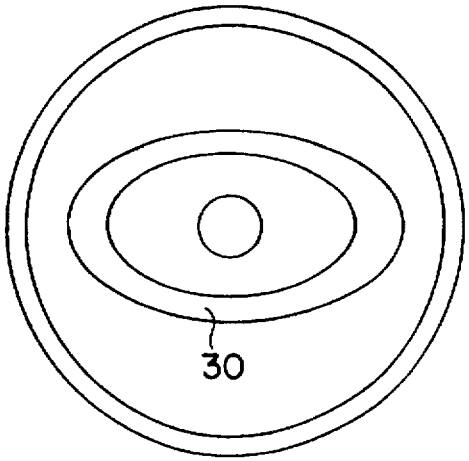
FIG. 6 shows an outside view of a modified embodiment having an oval bead projecting from the inner contour of the drill bit base.
Figure 7A:
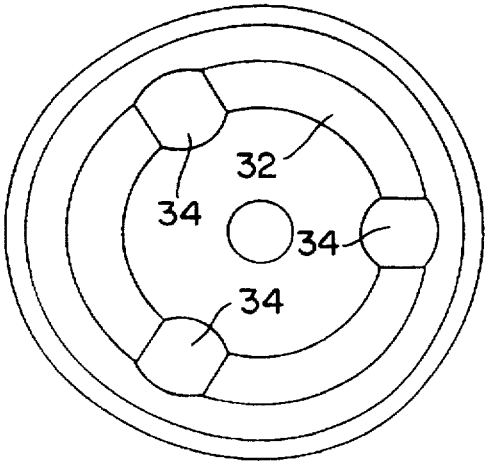
FIGS. 7A and 7B respectively show an outside view and a cross-sectional view of another modified embodiment, with a bead that is repeatedly interrupted.
Figure 7B:
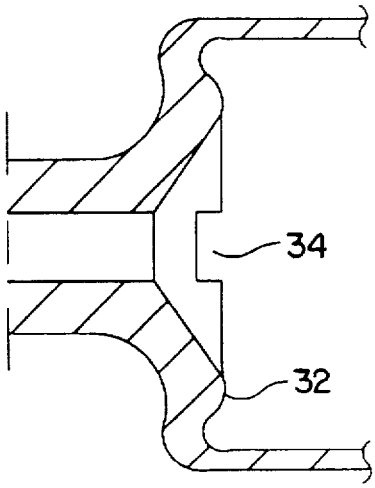
Figure 8:
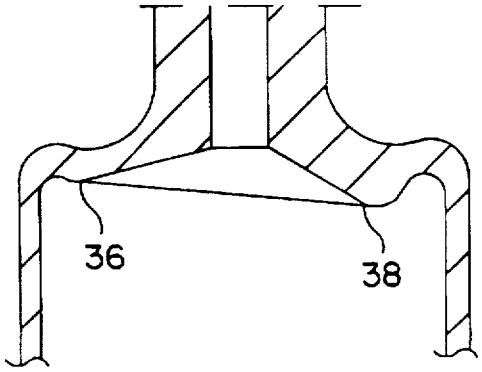
FIG. 8 shows a cross-sectional view of a further modified embodiment which is provided with a plurality of prominences that vary in height.

Although the first and second exemplary embodiments employ annular beads 10 and 18 to crush the material that has been drilled, other alternatives may be employed for this purpose in modified embodiments. For example, the modified embodiment shown in FIG. 6 has a bead 30 with an oval form projecting from the inner contour of the drill bit base. In the modified embodiment shown in FIGS. 7A and 7B, a bead 32 is repeatedly interrupted by interruptions 34. The modified embodiment shown in FIG. 8 has a plurality of prominences 36 and 38 which vary in height.

Figure 4:
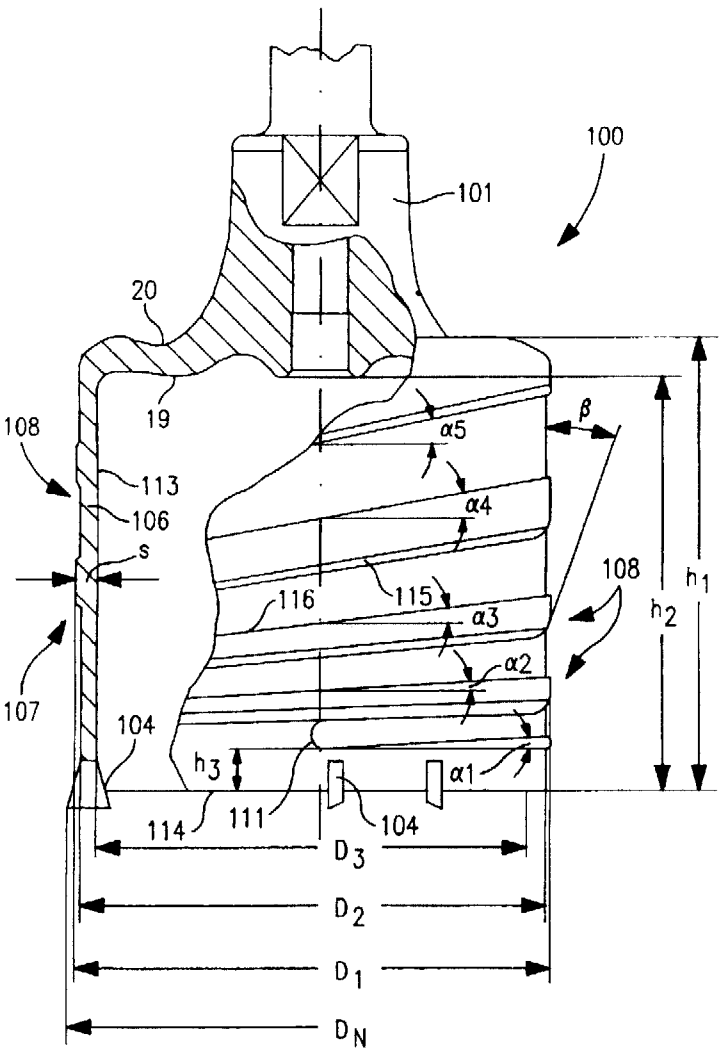
FIG. 4 shows a partially sectioned view of a drill bit according to the invention having a variable helix.

A third exemplary embodiment according to the invention for average drill-bit diameters of approximately 80 mm is shown in FIG. 4. The annular bead 19 and the curve shape of the outer contour of the drill-bit base 20 having one inflection point can be seen especially clearly in the partially sectioned side view. In rotary-percussive drilling, axial blows are applied to the drill bit during the rotation. A percussive motion induced by a drilling mechanism is transmitted via the drill-bit shank 6, 13, 101 and the drill-bit base 8, 15, 20 to the drilling body 9, 16, 106. The embodiment according to the invention of the drill-bit base permits a vibratory motion of the drilling body 9, 16, 106 relative to the drill-bit shank 6, 13, 101. Consequently an oncoming shock wave is damped to an especially small degree. If the drilling body 9, 16, 106 continues to penetrate into the material to be drilled, rock fragments already released for example are finally precrushed by the annular bead 10, 18, 19 and displaced into the conical hollow space 12, 17. The drill bit according to the invention can thereby penetrate into the material to be drilled down to its full drilling depth.

Figure 5:
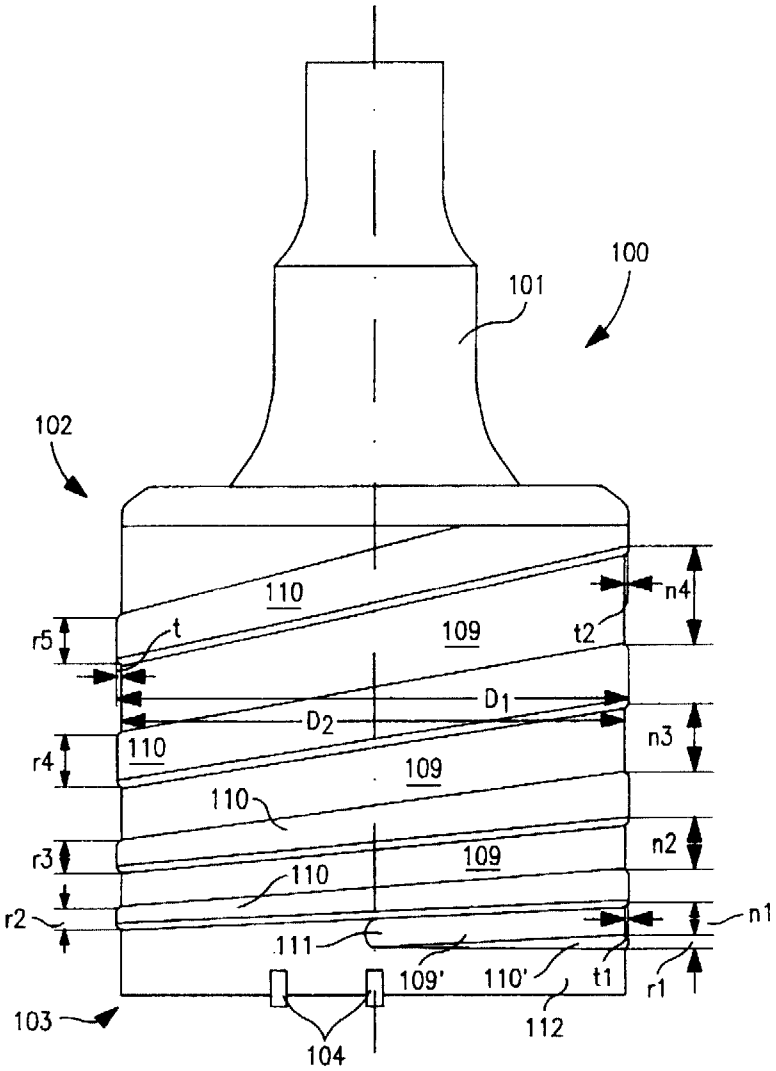
FIG. 5 shows the outside side view of the drill bit according to the invention from FIG. 4.

The drill bit 100 shown in FIGS. 4 and 5 has a coaxial insertion shank 101, a pot-like drilling body or a pot-like bit part 102, whose front end 103 or end 103 opposite the insertion shank has cutting edges 104 (only indicated) in a known manner for working a workpiece. The coaxial insertion shank 101 merges into a thin-walled cylindrical wall part 106 via a thin-walled drill-bit base 20 already described, which cylindrical wall part 106 has a delivery helix 108 on its outer contour 107. The preferably single-start delivery helix 108 consists of a spiral cuttings flute 109 having a flute width n1 to n4 with a minor diameter $D_2$ and in each case axially adjoining delivery-helix webs 110 having a web crest width r1 to r4 and an outside diameter $D_1$.

The outside diameter or nominal diameter $D_N$ of the drill bit is determined by the arrangement of the cutting teeth 104 in the front-end area of the wall part 106. This outside diameter $D_N$ is slightly larger than the outside diameter $D_1$ of the delivery helix 108, which outside diameter $D_1$ is formed by the outside diameter of the delivery-helix webs 110. The outside diameter of the cuttings flute 109 is accordingly designated by $D_2$ in the figure, the flute depth t resulting from the difference between these diameters or radii. The flute depth t of the cuttings flute 109 is in the range t≈1 to 1.5 mm. The wall thickness s of the cylindrical wall part 106 is in the order of magnitude s≈5 mm. This applies to a drill bit having a nominal diameter of $D_N$≈80 mm.

The flute depth t may be made constant or variable. In the latter case, a greater flute depth $t_1$ is selected in the area of the drill head 103 in order to enlarge the flute volume. This flute depth then decreases continuously in the direction of the shank end to a value $t_2$ while the wall thickness s is simultaneously enlarged, i.e. the core of the helix is strengthened. This results in strengthening of the drill bit overall. The values $t_1$≈1.5 mm and $t_2$≈1 mm may of course be optimized in another order of magnitude depending on the embodiment.

As further apparent from the figures, the cuttings flute 109 has a changing helix angle α1 to α4, where α1≈1° to 3°. The helix angle then increases up to the drill-bit base to a value of α5≈10° to 15°. The start of the delivery-helix flute is shown by reference numeral 111. This delivery-helix recess 111 lies axially only slightly above the arrangement (shown symbolically) of a cutting tooth 104, so that a large clearance cut is obtained in the front area of the drill bit. The front-end wall section 112 lying in front of the front-most delivery-helix flute 109' has an outside diameter $D_1$ which corresponds to the outside diameter of the delivery-helix webs 110. This enlarged diameter area results in an enlarged wall thickness for accommodating the cutting teeth 104 and thus in increased strength in this area.

On account of the very flat helix angle α1 of the delivery-helix flute 109' in the area of the drill head, only a very small web width r1 is obtained for the bottommost delivery-helix web 110' in the figure, which web width r1 quickly increases, however, to a larger value r2 or r3. The web width r of the delivery-helix webs 110 overall is to be kept as small as possible, so that—apart from the start of the delivery helix—only a very slight increase or no further increase in the crest width r2 to r5 of the delivery-helix webs 110 to the values r2 to r5≈constant is aimed for. In contrast, the width n1 to n4 of the cuttings flute 109 is preferably to increase continuously so that the volume of the respective cuttings flute increases constantly. Enough cuttings may thereby be received on the one hand, which are quickly removed on account of the increasing cuttings helix angle. Thus no build-up of cuttings occurs despite only a small depth t of the cuttings flutes, which are essentially rectangular in cross-section.

In the exemplary embodiment according to FIG. 4, the following technical data are realized in a preferred exemplary embodiment:

The nominal diameter of the drill bit depends on the lateral projection of the cutting teeth 104 and is $D_N$≈80 mm. The outside diameter of the delivery-helix webs is $D_1$≈78 mm and the minor diameter of the cuttings flutes 109 is $D_2$≈76 mm. These dimensions are adapted to one another in such a way that the flute depth t works out to be about 1 to 1.5 mm. The flute depth may also be variable.

The inside diameter of the pot-like bit part 110 is $D_3$≈68 mm, which leads to a constant or variable wall thickness s≈3.5 to 5 mm, measured between inner wall 113 and outside diameter $D_1$ of the delivery-helix web 110.

The start of the recessed flute 111 lies approximately at a height h3≈5 mm above the bottom edge 114 of the drill bit. The flute width n1 in the front-end area of the drill bit starts at a size n1≈4 to 6 mm and increases continuously to a size n4≈10 to 15 mm. The web width here remains constant at r2 to r5≈5 mm.

The height h1 of the drill bit from the front end up to the bit base 20 is h1≈75 mm, and the inner height from the front end 114 up to the inner bit base is h2≈68 mm.

The top flank 115 (shown in FIG. 4) of each cuttings flute 109 has a bevel with an angle β≈20°. The bottom flank 116 is designed to be relatively sharp-edged, i.e. radially orientated or perpendicular to the surface.

What is claimed is:

1. A drill bit for rotary-percussive drilling, the drill bit having an axis, comprising: an axially arranged drill-bit shank (6, 13, 101); a thin walled cylindrical drilling body (9, 16, 106) which is open at a drilling side; and a drill-bit base (8, 15, 20) extending essentially radially from the drill-bit shank (6, 13, 101) to the drilling body (9, 16, 106), wherein the drill-bit base has an outer contour in the radial direction, which outer contour follows an undulating curve shape (2, 3, 4) which has at least one inflection point.

2. The drill bit as claimed in claim 1, wherein the curve shape (2, 3, 4) which is followed by the outer contour of the drill-bit base (8, 15, 20) is a differentiable function with a derivative that is continuous.

3. The drill bit as claimed in claim 1, wherein the curve shape (2, 3, 4) which is followed by the outer contour of the drill-bit base is a sinusoidal shape with an amplitude that decreases radially outwardly from the drill-bit shank.

4. The drill bit as claimed in claim 1, wherein the drill-bit base (8, 15, 20) has an inner contour in the radial direction, which inner contour follows a curve shape (2, 3, 4) which has at least one inflection point.

5. The drill bit as claimed in claim 4, wherein the inner contour of the drill-bit base (8, 15, 20) follows the outer contour in at least one radial section.

6. The drill bit as claimed in claim 5, wherein the curve shape which is followed by at least one of the outer contour and the inner contour of the drill-bit base has a linear section.

7. The drill bit as claimed in claim 1, wherein the drill-bit base has an inner contour with at least one prominence (10, 18, 19) which projects to crush material that is to be drilled.

8. The drill bit as claimed in claim 7, wherein the at least one prominence projecting from the inner contour of the drill-bit base comprises an annular bead (10, 18, 19).

9. The drill bit as claimed in claim 7, wherein the at least one prominence projecting from the inner contour of the drill-bit base comprises a bead having an oval form.

10. The drill bit as claimed in claim 8, wherein the bead is repeatedly interrupted.

11. The drill bit as claimed in claim 7, wherein the at least one prominence projecting from the inner contour of the drill-bit base comprises a plurality of prominences which vary in height.

12. The drill bit as claimed in claim 7, wherein the inner contour of the drill-bit base runs up at an angle to the axis in a radially inner area (11) to form a conical hollow space (12, 17) up to a bore for receiving a center drill (7, 14).

13. The drill bit as claimed in claim 1, wherein the drilling body (106) has an outer side with a helical cuttings-discharge flute (109) and a helical web (110) that is disposed between turns of the flute (109), wherein the flute (109) has a flute width (n) and a helix angle (α) and the web (110) has a crest with a crest width (r), wherein the helix angle (α) of the flute (109) is smallest adjustment the drilling side (103) of the drilling body (106) and increases toward the shank (101) while the flute width (n) widens, and wherein the crest width (r) of the web (110) is approximately constant during a plurality of turns of the web (110).

14. The drill bit as claimed in claim 13, wherein the flute (109) has a flute depth (t) that is constant.

15. The drill bit as claimed in claim 13, wherein the helix angle ($\alpha$) of the flute (109) has a size of $\alpha 1 \approx 2°$ to 4° adjacent the drilling side (103) of the drilling body (106) and increases to a size of $\alpha 4 \approx 10°$ to 15° in a rear area that is spaced apart from the drilling side (103).

16. The drill bit as claimed in claim 13, wherein the flute width (n) of the helix (109) increases continuously from a starting end (111) adjacent the drilling side (103) of the drilling body (106) toward the shank (101).

17. The drill bit as claimed in claim 1, wherein the drill bit is a unitary member in which the drill-bit shank is integrally connected to the drill-bit base and the drill-bit base is integrally connected to the drilling body.

18. The drill bit as claimed in claim 1, wherein the drill-bit base has an inner side with an axially arranged bore for receiving a center drill.

19. The drill bit as claimed in claim 1, wherein the drilling body has an interior, and wherein the drill-bit base protrudes only minimally, at most, into the interior of the drilling body.

20. The drill bit as claimed in claim 13, wherein the flute (109) has a flute depth (t) that varies, and the drilling body (106) has a well thickness in the range of about 3.5 mm to about 5 mm.

21. A drill bit for rotary-percussive drilling, the drill-bit having an axis, comprising: an axially arranged drill-bit shank (6, 13, 101); a thin-walled cylindrical drilling body (9, 16, 106) which is open at a drilling side; and a drill-bit base (8, 15, 20) extending essentially radially from the drill-bit shank (6, 13, 101) to the drilling body (9, 16, 106), wherein the drill-bit base has an outer contour in the radial direction, which outer contour follows a curve shape (2, 3, 4) which has at least one inflection point, wherein the drill-bit base has a wall thickness, wherein the drilling body has a wall thickness, and wherein the wall thickness of the drill-bit base, at least in a radially outer section, is approximately the same as the wall thickness of the cylindrical drilling body.

22. A drill bit for rotary-percussive drilling, the drill bit having an axis, comprising: an axially arranged drill-bit shank (6, 13, 101); a thin-walled cylindrical drilling body which is open at a drilling side; and a drill-bit base (8, 15, 20) extending essentially radially from the drill-bit shank (6, 13, 101) to the drilling body, wherein the drill-bit base has an outer contour which passes through a relative extremum in the radial direction, the relative extremum being a minimum, wherein the outer contour of the drill-bit base (15) has a rising radially outer section which joins the cylindrical drilling body (16), and wherein the drill bit is a unitary member in which the drill-bit shank is integrally connected to the drill-bit base and the drill-bit base is integrally connected to the drilling body.

23. The drill bit as claimed in claim 22, wherein the outer contour of the drill-bit base (15) has a curve shape which is a differentiable function with a derivative that is continuous.

24. The drill bit as claimed in claim 22, wherein the drill-bit base has an inner contour which passes through a relative extremum in the radial direction, the relative extremum of the inner contour being a minimum.

25. The drill bit as claimed in claim 24, wherein the inner contour of the drill-bit base (15) follows the outer contour in at least one radial section.

26. The drill bit as claimed in claim 24, wherein at least one of the outer contour and the inner contour of the drill-bit base has a linear section.

27. The drill bit as claimed in claim 24, wherein the inner contour of the drill-bit base (8, 15, 20) follows a curve shape (2, 3, 4) which has at least one inflection point.

28. The drill bit as claimed in claim 22, wherein the drill-bit base has an inner side with an axially arranged bore for receiving a center drill.

29. The drill bit as claimed in claim 22, wherein the drilling body has an interior and wherein the drill-bit base protrudes only minimally, at most, into the interior of the drilling body.

30. A drill bit for rotary-percussive drilling, the drill bit having an axis, comprising: an axially arranged drill-bit shank (6, 13, 101); a thin-walled cylindrical drilling body which is open at a drilling side; and a drill-bit base (8, 15, 20) extending essentially radially from the drill-bit shank (6, 13, 101) to the drilling body, wherein the drill-bit base has an outer contour which passes through a relative extremum in the radial direction, the relative extremum being a minimum, wherein the outer contour of the drill-bit base (15) has a rising radially outer section which joins the cylindrical drilling body (16), wherein the drill-bit base has a wall thickness, wherein the drilling body has a wall thickness, and wherein the wall thickness of the drill-bit base (15), at least in a radially outer section, is approximately the same as the wall thickness of the cylindrical drilling body.

* * * * *